US006767239B2

(12) United States Patent
Fukamachi

(10) Patent No.: US 6,767,239 B2
(45) Date of Patent: Jul. 27, 2004

(54) CONNECTOR WITH INTERENGAGEABLE RIB AND GROOVE FOR GUIDING CONNECTION AND A METHOD OF ASSEMBLING SUCH A CONNECTOR

(75) Inventor: Makoto Fukamachi, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/298,362

(22) Filed: Nov. 15, 2002

(65) Prior Publication Data

US 2003/0096528 A1 May 22, 2003

(30) Foreign Application Priority Data

Nov. 16, 2001 (JP) ..... 2001-352096

(51) Int. Cl.[7] ..... H01R 13/64
(52) U.S. Cl. ..... 439/378; 439/374; 439/379
(58) Field of Search ..... 439/374–378, 439/352, 488–489, 379

(56) References Cited

U.S. PATENT DOCUMENTS 5,044,994 A 9/1991 Van Woensel ..... 439/681
6,095,843 A * 8/2000 Kaneko et al. ..... 439/352
6,196,867 B1 * 3/2001 Kawase et al. ..... 439/489
6,213,793 B1 * 4/2001 Norizuki et al. ..... 439/157
6,575,775 B2 * 6/2003 Hasegawa et al. ..... 439/188
2001/0021604 A1 * 9/2001 Held et al. ..... 439/378
2001/0039144 A1 * 11/2001 Osawa et al. ..... 439/589
2002/0064989 A1 * 5/2002 Sato et al. ..... 439/382

* cited by examiner

*Primary Examiner*—Michael C. Zarroli
(74) *Attorney, Agent, or Firm*—Anthony J. Casella; Gerald E. Hespos

(57) ABSTRACT

Ribs (16) are formed on the outer surface of a female housing main body (13) such that the front ends thereof are retracted from the front end of the female housing main body (13). By setting this retracted distance (D) larger than a dimension (C) along depth of connection over which first guiding surfaces (26A) are formed, the ribs (16) enter guide grooves (25) after the female housing main body (13) is guided to substantially correct its disalignment. Thus, second guiding surfaces (26B) can be smaller, thereby making the opening edges of the guide grooves (25) smaller. This enables the miniaturization of a connector provided with the ribs (16) for the twisting connection preventing purpose.

9 Claims, 8 Drawing Sheets

CONNECTOR WITH INTERENGAGEABLE RIB AND GROOVE FOR GUIDING CONNECTION AND A METHOD OF ASSEMBLING SUCH A CONNECTOR

BACKGROUND OF THE INVENTION

1. Field of the Invention

The invention relates to a connector with a twisting connection preventing means and to a method for assembling such a connector.

2. Description of the Related Art

Some connectors have a female connector housing that is fit into a receptacle of a male connector housing for connection. The connectors often have a twisting connection preventing means for preventing the male and female housings from being connected in a rotationally improper orientation. For example, a rib may project from the outer circumferential surface of the female housing and may extend along connecting directions of the two housings. A guide groove may be formed in the inner circumferential surface of the receptacle of the male housing for closely engaging the rib. Thus, the female housing can be fit straight into the receptacle by engaging the rib with the guide groove. The rib is positioned at the front end of the female housing to prevent a twisting connection at an early stage of the connection process.

Connectors of this type also may have guiding surfaces at the opening edge of the receptacle of the male connector housing and at the opening edge of the guide groove to correct the misalignment of the two connectors and to achieve a smooth connection. Large guiding surfaces are formed to correct the misalignment in connectors in which the male and female housings are automatically positioned, such as in self-aligning connectors.

The rib of the above-described connector is fit into the guide groove at the same time the female connector housing is fit into the receptacle. Thus, as shown in FIG. 8, a guiding surface 3 at the opening edge of a guide groove 2 for the insertion of a rib 1 needs to be substantially as large as a guiding surface 5 at the inner opening edge of the receptacle 4 to effectively correct the misalignment. This makes the outer shape of the receptacle 4 larger, and hence makes the connector larger.

The present invention was developed in view of the above problem, and an object thereof is to further miniaturize a connector provided with a twisting connection preventing means.

SUMMARY OF THE INVENTION

The invention is directed to connector with first and second housings. The first housing has a receptacle and the second housing is configured to fit into the receptacle. At least one rib is formed on the outer surface of the second housing and extends along the connecting direction of two housings. At least one guide groove is formed in the inner surface of the receptacle for guiding the rib therein, and at least one guiding surface is formed at opening edges of the inner surface of the receptacle and/or the guide groove. The front end of the rib is retracted from the front end of the second housing by a retracted distance that is longer than a dimension along the connecting direction over which the guiding surface is formed on the receptacle.

The connectors may be misaligned in the process of fitting the second housing into the receptacle of the first housing.

However, one edge at the front of the second housing first contacts the guiding surface at the opening edge of the receptacle. At this stage, the front end of the rib has not yet contacted the guiding surface on the guide groove. The second housing then is fit further so that the edge at the front end of the second housing slides on the guiding surface, thereby correcting the misalignment and guiding the second housing into the receptacle. The rib enters the guide groove after the guiding of the second housing is completed. The front end of the rib contacts the guiding surface on the guide groove and slides thereon to correct the inclination even if the second housing is inclined slightly from its proper posture. Thus, the rib is guided into the guide groove. In this way, the second housing can be fit straight into the receptacle without twisting.

As described above, the rib and the guide groove already are positioned with respect to each other when the second housing is fit into the receptacle. Thus, the guiding surface for the rib needs not be as large as the guiding surface for the second housing. Accordingly, the opening edge of the guide groove and the entire receptacle can be smaller. This consequently enables the miniaturization of the connector.

A terminal preferably is accommodated in the first connector so that a portion of the terminal projects into the receptacle. The retracted dimension preferably is shorter than a distance between the front end of the receptacle and the leading end of the terminal projecting into the receptacle. Thus, the front end of the second housing cannot contact and bend the leading end of the terminal before the rib is guided into the guide groove.

The rib(s) preferably are arranged to prevent an improper connection of the housings.

The guide groove preferably comprises at least one auxiliary guiding surface for contacting the corresponding rib to guide the connection of the housings.

The guiding surface is wider to correct the misalignment of the second housing with respect to the receptacle over a wider area. Thus, the auxiliary guiding surface is smaller than the guiding surface.

The guide groove may be formed by bulging out a portion of the receptacle.

The engaging edge of the second housing and/or the rib may have a slanted or rounded guiding portion.

The invention also relates to a method of assembling, mounting or connecting a connector that has first and second housings. The method comprises fitting the second housing into a receptacle in the first housing. The connection is guided by at least one guiding surface formed on at least part of the opening edges of the inner surface of the receptacle. The method continues by engaging at least one rib formed substantially along the connecting direction of housings and on the outer surface of the second housing with at least one guide groove formed in the inner surface of the receptacle after the second housing is fit into the receptacle by a fitting distance. The fitting distance is longer than a dimension along the connecting direction over which the guiding surface is formed on or at the receptacle.

At least one terminal may be accommodated in the first connector so that a portion of the terminal projects into the receptacle. The fitting distance is shorter than a distance between the front end of the receptacle and the leading end of the terminal that projects into the receptacle.

Preferably, an improper connection of the housings is prevented by the rib(s).

The connection of the connector housings preferably is guided further by contacting at least one auxiliary guiding surface of the guide groove with the corresponding rib.

Misalignment of the second housing with respect to the receptacle preferably is corrected over a wider area by the wider guiding surface. The guiding surface preferably is smaller than the guiding surface.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A waiting or fixed type connector in accordance with the invention is illustrated in FIGS. 1 to 7. The connector has a male housing 11 and a female housing 12 that is mounted on a panel P beforehand. The male housing 11 is fitted on the female housing 12. In the following description, engaging or mating sides of the housings 11, 12 are referred to as the front sides.

Figure 5:
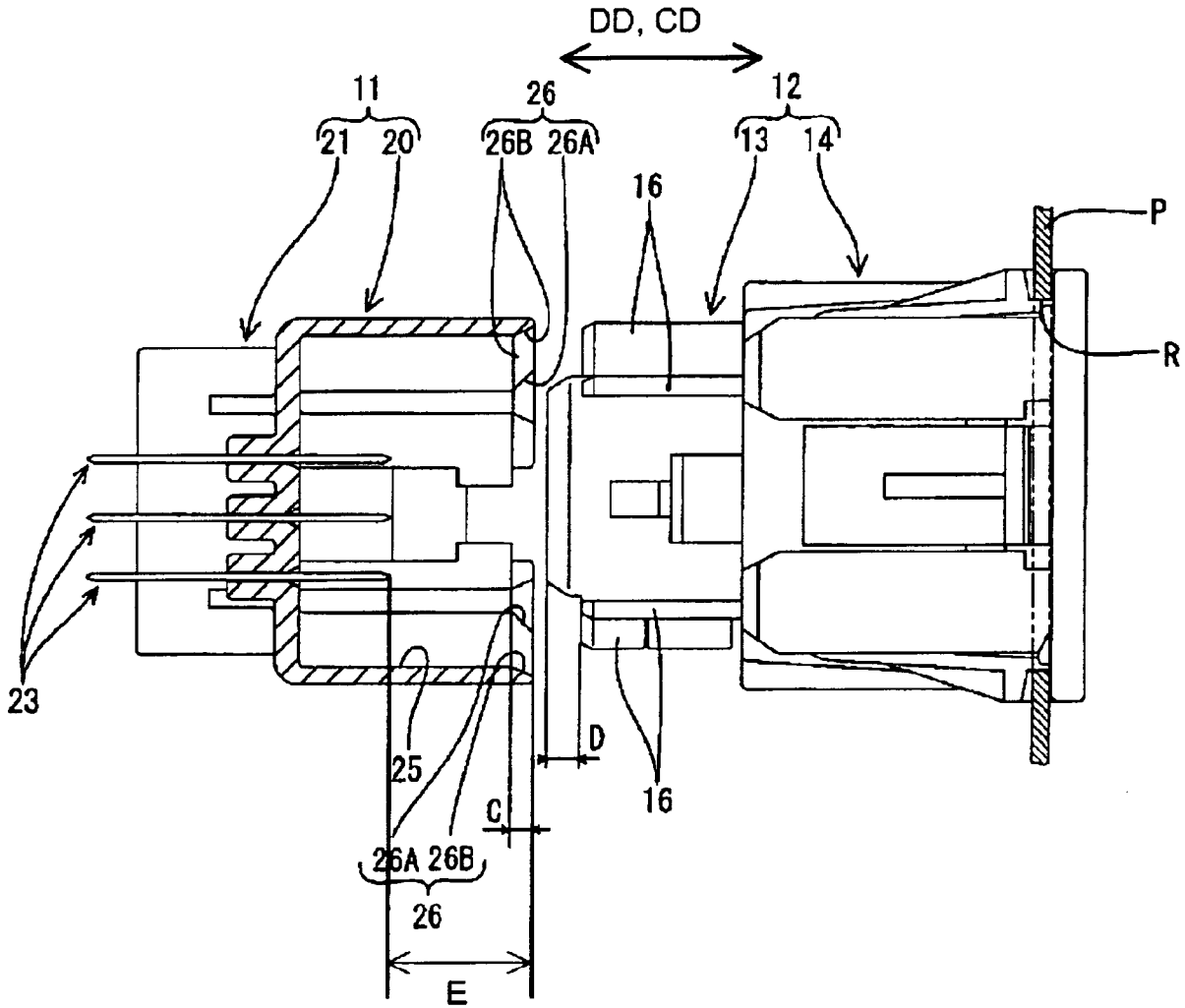
FIG. 5 is a side view partly in section showing a process of connecting the male and female housings.
Figure 6:
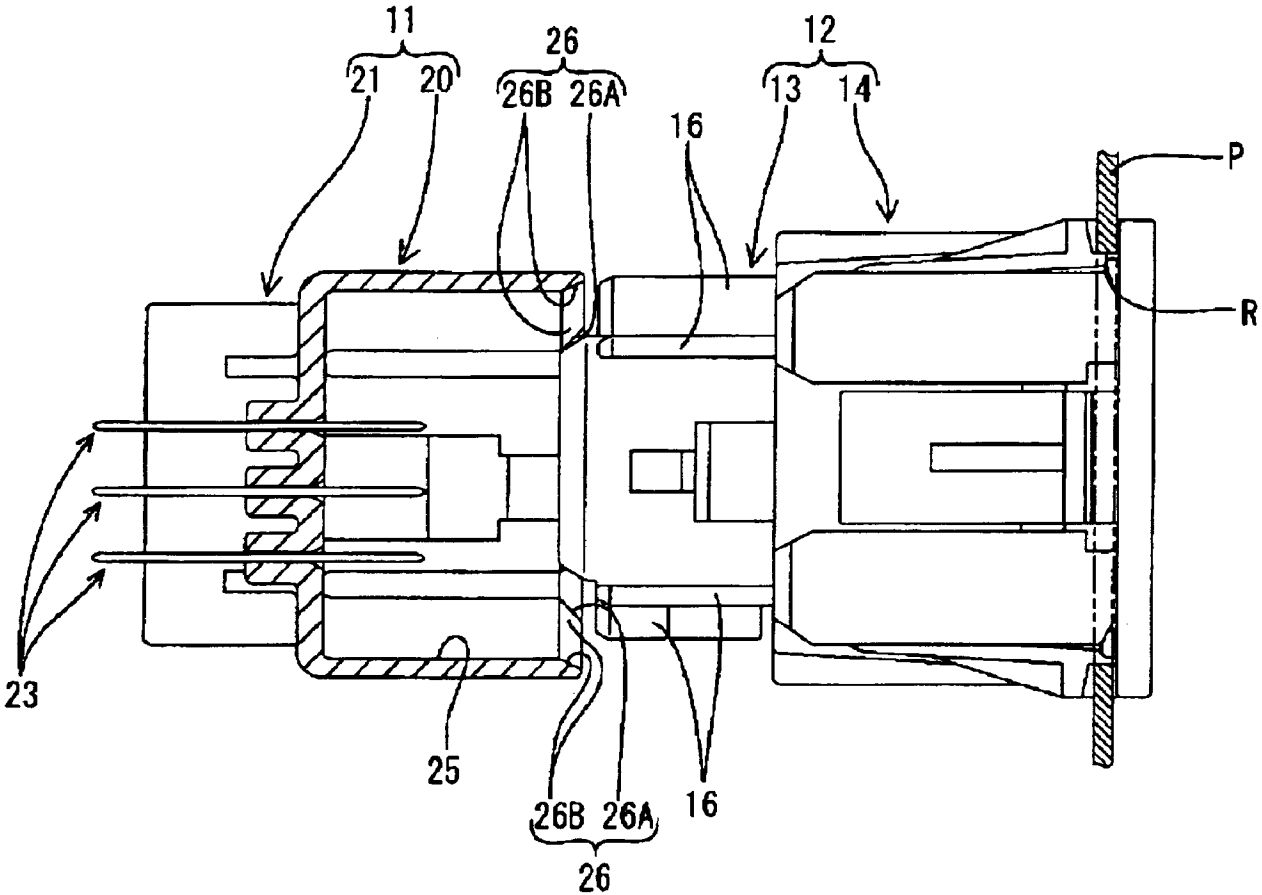
FIG. 6 is a side view partly in section showing the process of connecting the male and female housings.

The female housing 12 has a substantially box-shaped casing 14 and a female housing main body 13. The female housing main body 13 is mounted in the casing 14 by being introduced from behind through a mount hole R formed in the panel P, as shown in FIG. 5. Additionally, substantially half of the female housing main body 13 projects forward from the casing 14.

Figure 1:
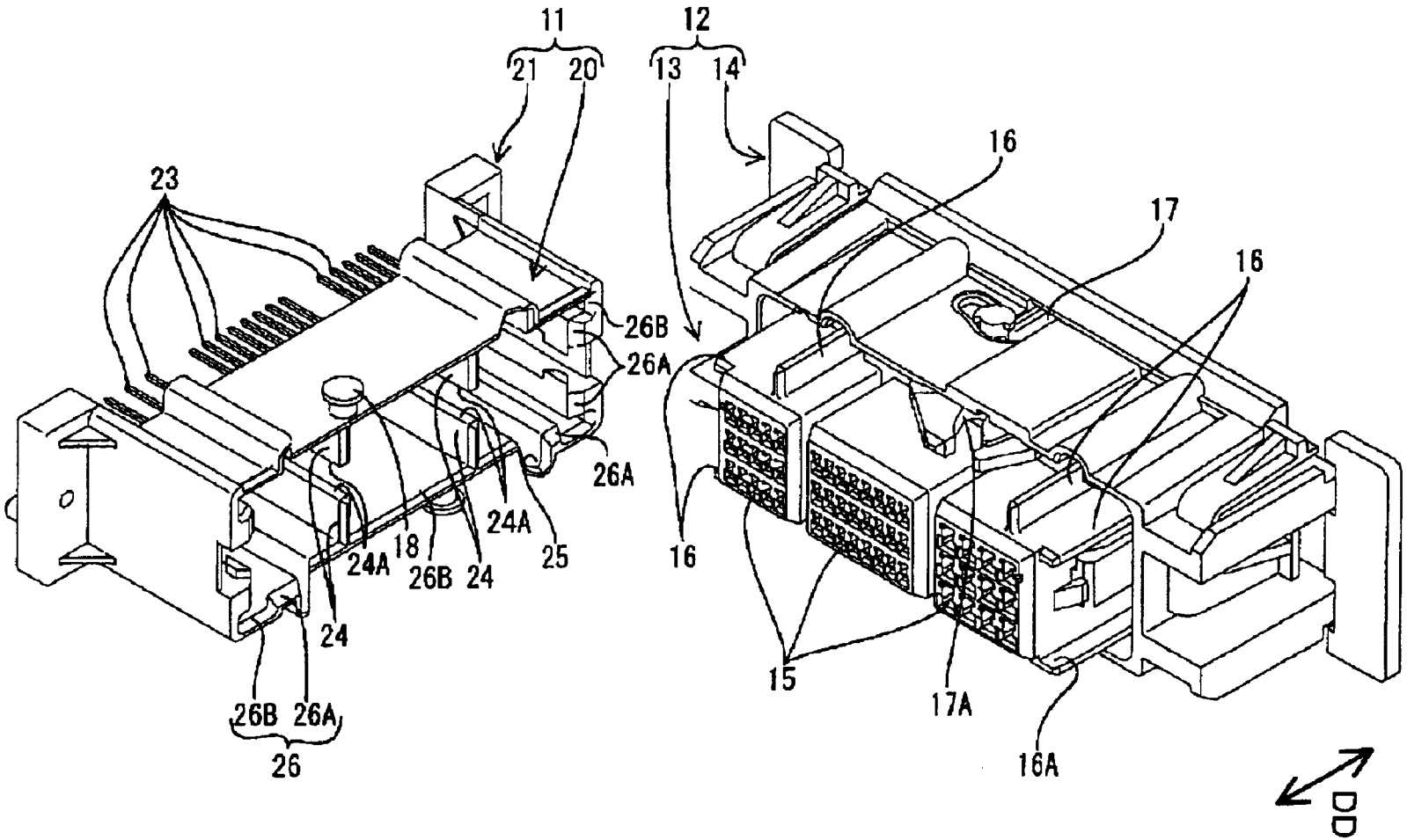
FIG. 1 is a perspective view of male and female housings according to one embodiment of the present invention.
Figure 2:
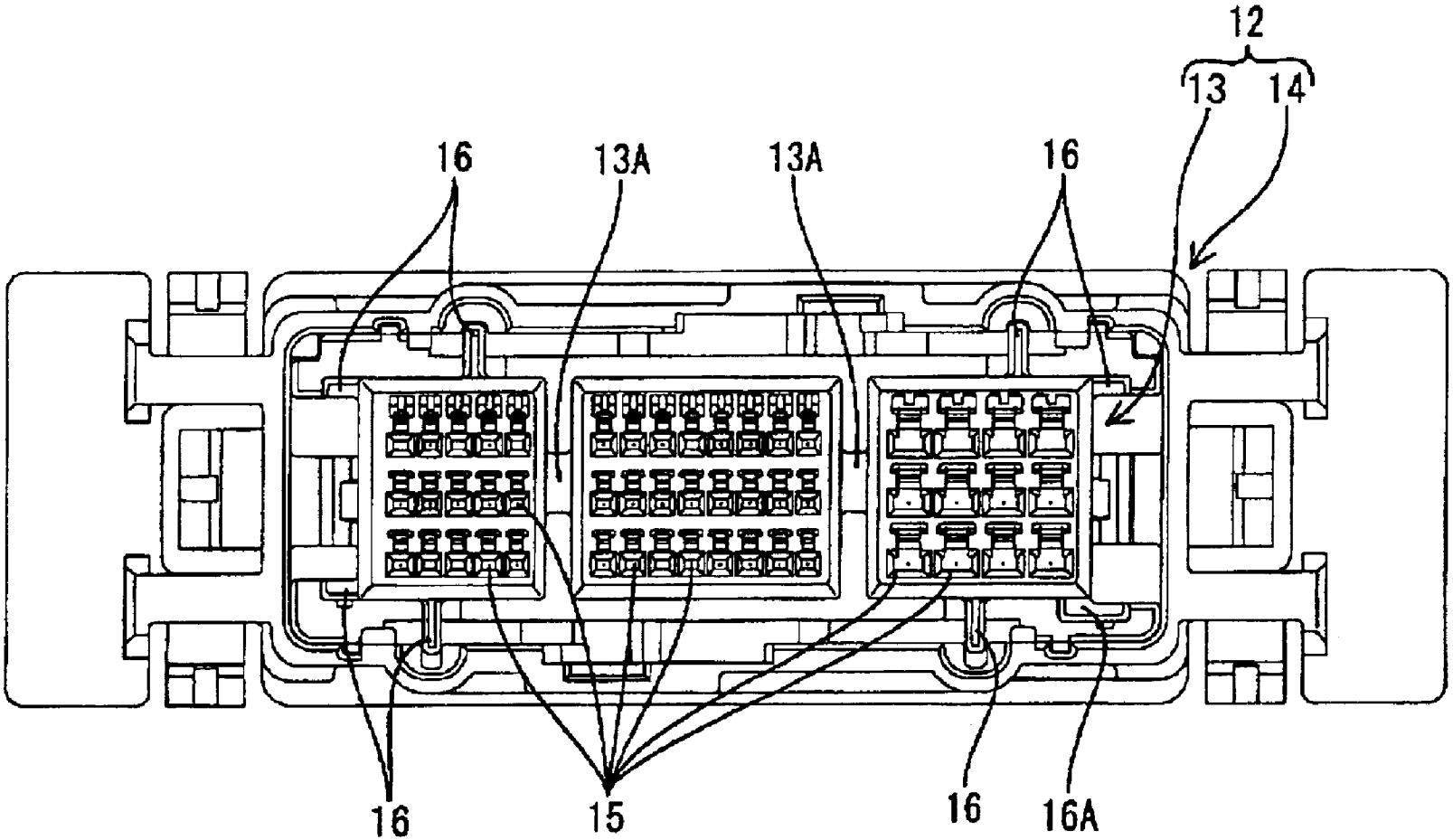
FIG. 2 is a front view of the female housing.

The female housing main body 13, as shown in FIG. 2, is substantially in the form of a flat block and has three spaced apart housings integrally or unitarily coupled by coupling walls 13A. Cavities 15 are arrayed at three stages in each housing for accommodating female terminal fittings (not shown).

Figure 3:
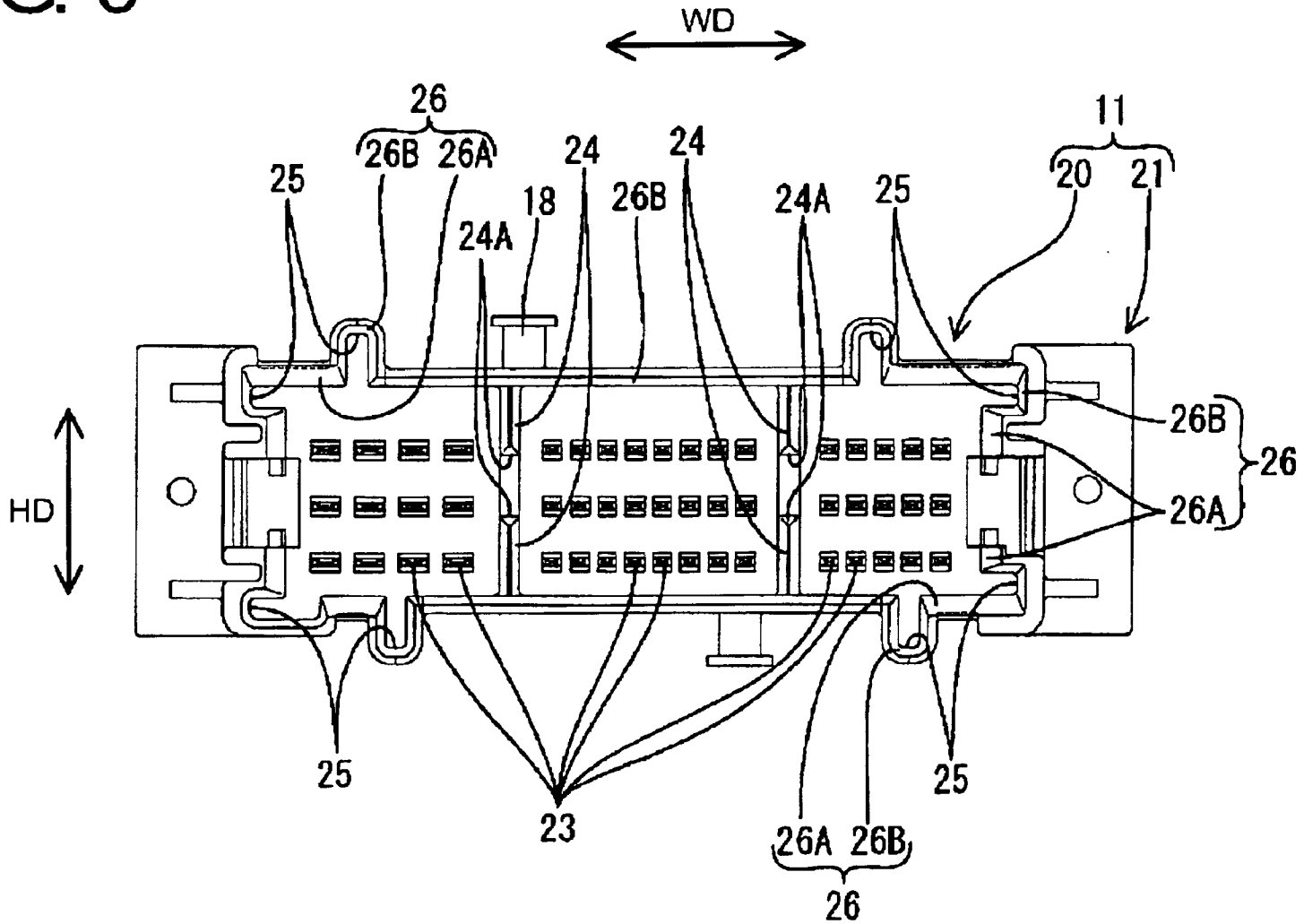
FIG. 3 is a front view of the male housing.
Figure 4:
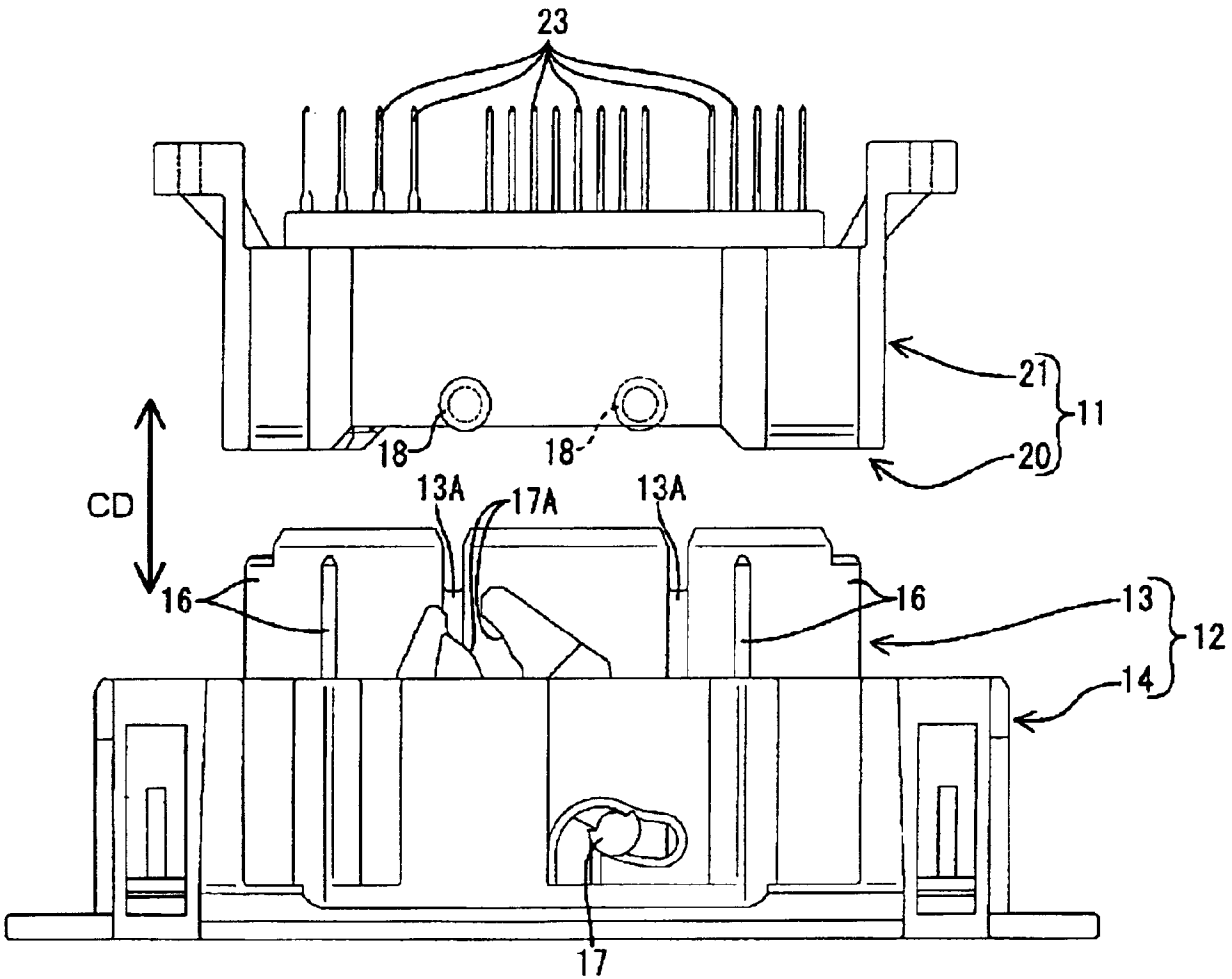
FIG. 4 is a plan view of the two housings before connection.

The male housing 11, as shown in FIG. 3, has a substantially flat box-shaped receptacle 20 for receiving the female housing main body 13 and L-shaped support brackets 21 for supporting the receptacle 20 from opposite left and right sides. Male terminal fittings 23 that correspond to the female terminal fittings are inserted through the rear wall of the receptacle 20 so that leading ends of the male terminal fittings 23 project into the receptacle 20. Partition walls 24 extend substantially along connecting direction CD in the receptacle 20 and align with the spacings between the housings of the female housing main body 13. An escaping portion 24A is formed in the middle of each partition wall 24 along a height direction HD. Thus, the partition walls 24 can fit into the spacings between the housings, and the coupling walls 13A can escape in the process of connecting the two housings 11, 12.

The female housing 12 has a lever 17 formed with a cam groove 17A and the male housing has a cam follower pin 18 that fits into the cam groove 17 during an early stage of connecting the male and female housings 11, 12. The lever 17 then is operated and the cam follower pin 18 is displaced along the cam groove 17A to pull the two housings 11, 12 toward each other. Thus, the front side of the receptacle 20 is inserted into the housing casing 14.

Ribs 16 extend along the connecting direction CD on the outer surface of the female housing main body 13. Specifically, two ribs 16 are at a specified spacing on each of the upper and lower outer surfaces, and two ribs 16 are on each of the left and right outer surfaces. Additionally, an upside-down connection preventing rib 16A extends from the bottom surface of the female housing main body 13, as shown in FIG. 2, to prevent the female housing main body 13 from being fit into the receptacle 20 in an improper orientation. The front engaging edge 13A of the housing main body 13 is slanted or rounded to guide the connection of the housings 11, 12. Moreover, the ribs 16, 16A also are rounded or slanted to guide the connection of the housings 11, 12.

Guide grooves 25 are formed by bulging out portions of the surrounding wall of the receptacle 20 of the male housing 11 along the entire depth direction DD. The guide groves 25 are in positions to guide and closely receive the ribs 16 of the female housing main body 13 during the connection of the two housings 11, 12.

Slanted guiding surfaces 26 are formed on the inner opening edge of the receptacle 20 and the opening edges of the guide grooves 25. The guiding surfaces 26 on the upper and lower outer surfaces of the receptacle 20 outside the guide grooves 25 and those on the left and right outer surfaces between the guide grooves 25 define first guiding surfaces 26A. The guiding surfaces 26 on the upper and lower outer surfaces of the receptacle 20 between or at the guide grooves 25 define second guiding surfaces 26B (FIG. 5). The first guiding surfaces 26A are wider to correct the misalignment of the female housing main body 13 with respect to the receptacle 20 over a wide area along a width direction WD and/or along the height direction HD. However, the second guiding surfaces 26B are smaller than the first guiding surfaces 26A (FIG. 3).

The front ends of all the ribs 16, including the rib 16A, are retracted by a distance D from the front end of the female housing main body 13, and the distance D is longer than a dimension C along the depth direction DD or connection direction CD over which the first guiding surfaces 26A are formed in the receptacle 20. The distance D is shorter than a distance E between the front ends of the male terminals 23 and the front end of the receptacle 20.

If the male and female housings 11, 12 are misaligned in the connecting process, one edge at the front end of the female housing main body 13 first contacts the first guiding surfaces 26A of the receptacle 20. When the female housing 13 is fit further, the edge at the front end of the female housing main body 13 slides on the first guiding surfaces 26A as the two housings 11, 12 are connected to correct the misalignment of the housings 11, 12.

The ribs 16 are retracted from the front end of the female housing main body 13 by the distance D which exceeds the depth C of the first guiding surfaces 26A along the depth direction DD or connection direction CD. Thus, the front ends of the ribs 16 do not contact the second guiding surfaces 26B of the guide grooves 25 while the edge at the front end of the female housing main body 13 slides on the first guiding surfaces 26A. Further, the retracted distance D is shorter than the distance E between the front ends of the male terminals 23 and the front end of the receptacle 20. Hence, the front end of the female housing main body 13 cannot contact and bend the leading ends of the male terminals 23 before the ribs 16 are guided by the second guiding surfaces 26B at the guide grooves 25.

Figure 7:
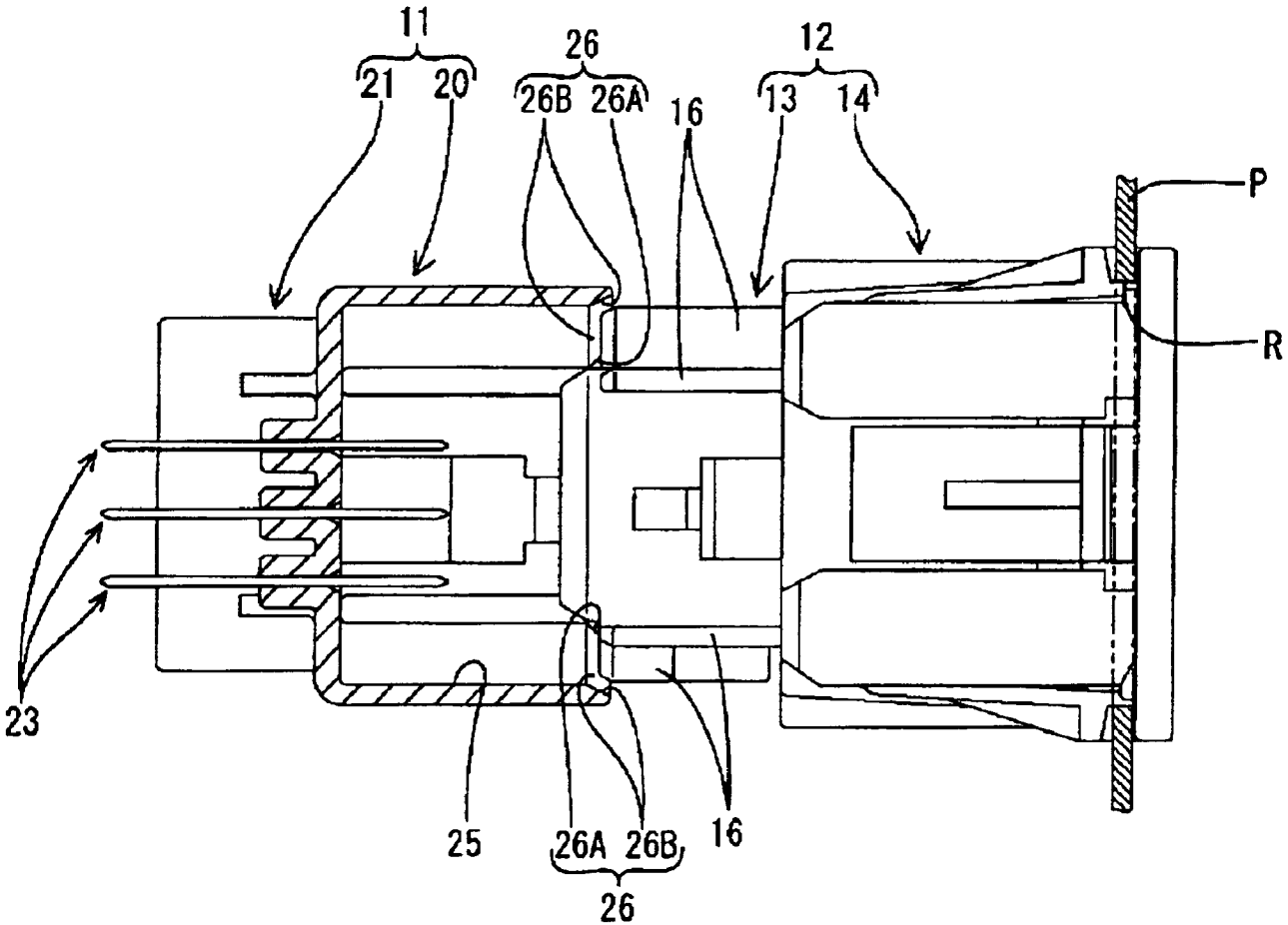
FIG. 7 is a side view partly in section showing the process of connecting the male and female housings.
Figure 8:
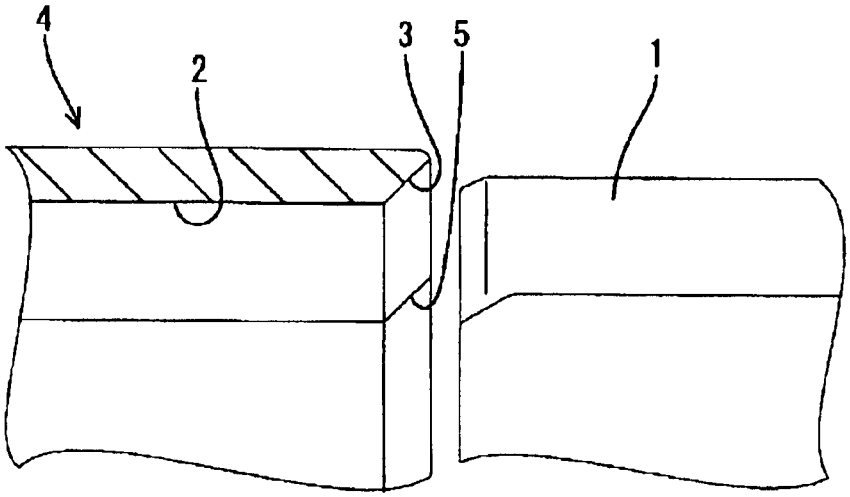
FIG. 8 PRIOR ART
FIG. 8 is a fragmentary enlarged view showing a portion of a prior art connector near a rib and a guide groove.

As shown in FIG. 7, the ribs 16 enter the guide grooves 25 after the first guiding surfaces 26A have substantially completed guiding the female housing main body 13. At this time, the female housing main body 13 may be slightly inclined from its proper posture. However, the front ends of the ribs 16 contact and slide on the second guiding surfaces 26B formed at the guide grooves 25 to correct the inclination of the female housing main body 13 and to guide the ribs 16 into the guide grooves 25. In this way, the female housing main body 13 fits substantially straight along the connection direction CD into the receptacle 20 without being twisted during connection.

Misalignment of the male housing 11 and the female housing main body 13 is corrected by guiding the female housing main body 13 and the first guiding surfaces 26A as described above. The second guiding surfaces 26B need not correct any remaining misalignment over a large area. Thus, the second guiding surfaces 26B need not be as large as the first guiding surfaces 26A and can be smaller. Therefore, the opening edges of the guide grooves 25 can be smaller, thereby making the entire receptacle 20 smaller.

The front ends of the ribs 16 on the outer surface of the female housing main body 13 are retracted from the front end of the female housing main body 13 to further miniaturize the connector provided with a twisting connection preventing means. The retracted distance D exceeds the dimension C over which first guiding surfaces 26A are formed. Thus, the ribs 16 enter guide grooves 25 after the female housing main body 13 is guided to correct its misalignment. As a result, the second guiding surfaces 26B can be made smaller, and the opening edges of the guide grooves 25 can be smaller. This enables the miniaturization of a connector provided with the ribs 16 for the twisting connection preventing purpose.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the guiding surfaces are slanted in the foregoing embodiment, they may be curved.

Although the invention is applied to a lever-type connector in the foregoing embodiment, it may be applied to connectors with no lever.

The present invention is also applicable to a connector in which a male housing with a small receptacle is fit into a female housing with a large receptacle. Ribs then are formed on the outer surface of the small receptacle and guide grooves are formed in the inner surface of the large receptacle.

What is claimed is:

1. A connector, comprising:

first and second housings, the first housing having a front end and a receptacle extending into the front end, the second housing being fittable into the receptacle along a connecting direction;

at least one rib formed on an outer surface of the second housing and being substantially parallel to the connecting direction of the housings;

at least one guide groove formed along an inner surface of the receptacle for slideably receiving the rib, the guide groove comprising at least one auxiliary guiding surface contacting the rib and guiding a connection of the housings, the rib and the guide groove being disposed to prevent an improper connection of the housings; and at least one guiding surface formed on an opening edge of the inner surface of the receptacle and extending a dimension along the connecting direction;

wherein the rib is retracted from the front end of the second housing by a retracted distance that exceeds the dimension over which the guiding surface is formed on the receptacle.

2. The connector of claim 1, wherein at least one terminal is accommodated in the first housing such that a portion of the terminal projects into the receptacle, the retracted distance being less than a distance between the front end of the receptacle and a leading end of the terminal projecting into the receptacle.

3. The connector of claim 1, wherein the guiding surface is formed for correcting misalignment of the second housing with respect to the receptacle over a wide area, whereas the auxiliary guiding surface is smaller than the guiding surface.

4. A connector, comprising:

first and second housings, the first housing having a front end and a receptacle extending into the front end, the second housing being fittable into the receptacle along a connecting direction;

at least one rib formed on an outer surface of the second housing and being substantially parallel to the connecting direction of the housings;

at least one guide groove formed along an inner surface of the receptacle for slideably receiving the rib, the guide groove being formed by bulging out a portion of the receptacle; and at least one guiding surface formed on an opening edge of the inner surface of the receptacle and extending a dimension along the connecting direction;

wherein the rib is retracted from the front end of the second housing by a retracted distance that exceeds the dimension over which the guiding surface is formed on the receptacle.

5. A connector comprising:

first and second housings, the first housing having a front end and a receptacle extending into the front end, the second housing being fittable into the receptacle along a connecting direction, a slanted surface being formed at an engaging edge portion of the second housing;

at least one rib formed on an outer surface of the second housing and being substantially parallel to the connecting direction of the housings, the rib being formed with a slanted surface; and at least one guide groove formed along an inner surface of the receptacle for slideably receiving the rib;

at least one guiding surface formed on an opening edge of the inner surface of the receptacle and extending a dimension along the connecting direction;

wherein the rib is retracted from the front end of the second housing by a retracted distance that exceeds the dimension over which the guiding surface is formed on the receptacle.

6. A method of assembling a connector, the connector having first and second housings, the method comprising the steps of:

fitting the second housing partly into a receptacle in the first housing by guiding the housings along at least one guiding surface formed at at least one of an opening edge of the inner surface of the receptacle and the guide groove;

guiding at least one rib formed substantially along connecting direction of two housings on the outer surface of the second housing with at least one auxiliary guiding surface of at least one guide groove formed in the inner surface of the receptacle; and engaging the rib with portions of the guide groove rearwardly from the auxiliary guiding surface of the guide groove.

7. The method of claim 6, wherein at least one terminal is accommodated in the first housing while a portion thereof is projecting into the receptacle, and the retracted distance is shorter than a distance between the front end of the receptacle and the leading end of the terminal projecting into the receptacle.

8. The method of claim 7, wherein an improper connection of the connector housings is prevented by the rib.

9. The method of claim 6, wherein the auxiliary guiding surface is smaller than the guiding surface.

* * * * *